US007644729B2

(12) United States Patent
Cho et al.

(10) Patent No.: US 7,644,729 B2
(45) Date of Patent: Jan. 12, 2010

(54) CAPACITY CONTROL VALVE

(75) Inventors: Ryosuke Cho, Tokyo (JP); Yoshihiro Ogawa, Tokyo (JP); Kohei Fukudome, Tokyo (JP)

(73) Assignee: Eagle Industry Co., Ltd., Tokyo (JP)

( * ) Notice: Subject to any disclaimer, the term of this patent is extended or adjusted under 35 U.S.C. 154(b) by 236 days.

(21) Appl. No.: 11/922,009

(22) PCT Filed: Jun. 8, 2006

(86) PCT No.: PCT/JP2006/311485

§ 371 (c)(1),
(2), (4) Date: Dec. 12, 2007

(87) PCT Pub. No.: WO2006/137270

PCT Pub. Date: Dec. 28, 2006

(65) Prior Publication Data

US 2009/0283164 A1 Nov. 19, 2009

(30) Foreign Application Priority Data

Jun. 22, 2005 (JP) ..... 2005-181518

(51) Int. Cl.
*F16K 11/044* (2006.01)

(52) U.S. Cl. ..... 137/625.27; 417/222.2

(58) Field of Classification Search ..... 417/222.2, 417/213, 216; 137/625.2, 625.18, 625.65, 137/625.67, 625.27, 625.25
See application file for complete search history.

(56) References Cited

U.S. PATENT DOCUMENTS

| | | | | |
|---|---|---|---|---|
| 7,018,179 | B2 | 3/2006 | Hirota | |
| 7,037,087 | B2 | 5/2006 | Uemura et al. | |
| 2005/0053474 | A1 * | 3/2005 | Hirota et al. | 417/222.2 |

FOREIGN PATENT DOCUMENTS

| | | |
|---|---|---|
| EP | 1 026 398 | 8/2000 |
| JP | 6-221265 | 8/1994 |
| JP | 2000-291542 | 10/2000 |
| JP | 2003-278650 | 10/2003 |
| JP | 2003-328936 | 11/2003 |
| JP | 2004-116407 | 4/2004 |
| JP | 2004-156575 | 6/2004 |

OTHER PUBLICATIONS

International Search Report issued Aug. 15, 2006 in the International (PCT) Application of which the present application is the U.S. National Stage.

* cited by examiner

*Primary Examiner*—John Rivell
*Assistant Examiner*—Craig M Schneider
(74) *Attorney, Agent, or Firm*—Wenderoth, Lind & Ponack, L.L.P.

(57) ABSTRACT

A capacity control valve has a communication path (31) for communicating a discharge chamber (11) and a control chamber (12); one valve chamber (36) in the middle of the communication path (31); communication paths (32, 31*b*) for communicating a suction chamber (13) and the control chamber (12); the other valve chamber (36) in the middle of the communication path (32); a valve body (40) including a first valve section (41) that opens and closes the communication path (31) and a second valve section (42) that opens and closes the communication path (32), the first and second valve sections being placed in the valve chamber (36) and performing the opening and closing operation in a manner opposite to each other; and a solenoid (60) for moving the valve body (40). The valve body (40) has a pressure receiving section (44) at its end section that is across the second valve section (42) from the first valve section (41), and the pressure receiving section (44) receives pressure in the control chamber. The pressure receiving area S3 of the pressure receiving section (44) is substantially the same as the difference between the pressure receiving area S2 of the second valve section (42) and the pressure receiving area S1 of the first valve section. The valve is reduced in size, an influence of the pressure in the control chamber is minimized, and stable capacity control with excellent response is enabled.

12 Claims, 7 Drawing Sheets

CAPACITY CONTROL VALVE

TECHNICAL FIELD

The present invention relates to a capacity control valve that controls the capacity or the pressure of a working fluid so that the capacity or the pressure thereof can be varied, and, more particularly, to a capacity control valve that controls the pressure of a control chamber of, for example, a capacity-variable compressor used in an air-conditioning system of, for example, an automobile.

BACKGROUND ART

A swash plate type capacity-variable compressor used in an air-conditioning system of an automobile or the like is provided with a rotary shaft that is rotated and driven by a rotation force of an engine, a swash plate connected to the rotary shaft with a variable inclination angle, a piston for compression that is connected to the swash plate and the like. This capacity-variable compressor controls the amount of refrigerant gas discharged while changing the stroke of the piston by changing the inclination angle of the swash plate.

The inclination angle of the swash plate can be continuously changed by adjusting a pressure balance acting on both faces of the piston through appropriate control of a pressure in a control chamber using a capacity control valve opening/closing-driven by an electro-magnetic force while using a suction pressure of a suction chamber into which a refrigerant gas is sucked, a discharge pressure of a discharge chamber from which the refrigerant gas pressurized by a piston is discharged, and a control chamber pressure of the control chamber (crank chamber) in which the swash plate is accommodated.

The capacity control valve includes a lead-in passage through which the discharge chamber and the control chamber are allowed to communicate with each other and through which a discharge fluid (refrigerant gas) is introduced into the control chamber, a first valve chamber formed in an enlarged shape at a place on the lead-in passage, a lead-out passage through which the suction chamber and the control chamber are allowed to communicate with each other and through which a fluid (e.g., refrigerant gas or blow by gas) is led out from the control chamber, a second valve chamber formed in an enlarged shape at a place on the lead-out passage, a valve body in which a first valve part that is disposed in the first valve chamber and that opens and closes the lead-in passage and a second valve part that is disposed in the second valve chamber and that opens and closes the lead-out passage are reciprocated together, and, at the same time, perform an open-close operation in mutually opposite directions (i.e., the second valve part is fully closed (or fully opened) when the first valve part is fully opened (or fully closed)), and a solenoid that operates the valve body, which is formed so that a discharge pressure acts on one side (first valve part side) of the valve body and a suction pressure acts on an opposite side (second valve part side) thereof, with an electro magnetic force so as to perform an open-close operation (see Patent Documents 1 and 2, for example).

Further, in this capacity control valve, a control-chamber pressure acts on the first valve part that receives a discharge pressure from an opposite side, and a control-chamber pressure acts on the second valve part that receives a suction pressure from an opposite side. With this structure, the influence of the control-chamber pressure on the valve body is counterbalanced, and only a differential pressure between the discharge pressure and the suction pressure is caused to act on the valve body so as to control the control-chamber pressure.

By the way, attention is paid to carbon dioxide ($CO_2$) to be used as a refrigerant gas serving as the replacement of a fron gas. The carbon dioxide is about ten times as great as the existing refrigerant gas in the pressure area (i.e., in pressure fluctuation width) to be used, and a differential pressure acting on the valve body becomes great because of a structure in which the two passages (i.e., the lead-in passage through which a discharge pressure and a control-chamber pressure are allowed to communicate with each other and the lead-out passage through which a suction pressure and a control-chamber pressure are allowed to communicate with each other) are opened and closed. As a result, when the valve body controls a fluid flow (i.e., flow rate), a differential pressure between the discharge pressure and the control-chamber pressure becomes greater than a differential pressure between the suction pressure and the control-chamber pressure, and hence the fluid flow of the lead-out passage opened and closed by the second valve part is a tendency to become shorter than the fluid flow of the lead-in passage opened and closed by the first valve part.

Therefore, to eliminate this tendency, there is a need to make the passage area of the lead-out passage opened and closed by the second valve part (and the opening area of a valve seat) greater than the passage area (opening area) of the lead-in passage opened and closed by the first valve part. If the opening area (passage area) is increased, a differential pressure caused by the control-chamber pressure is increased. Therefore, to maintain the balance of a force exerted on the valve body, the driving force of the solenoid by which the valve body is driven is required to be increased, in other words, the solenoid is required to been enlarged. This brings about an increase in device size and an increase in cost.

Patent Document 1: Unexamined Japanese Patent Publication No. 2003-328936

Patent Document 2: Unexamined Japanese Patent Publication No. 2004-116407

DISCLOSURE OF INVENTION

Problems to be Solved by the Invention

The present invention has been made in consideration of these circumstances. It is therefore an object of the present invention to provide a capacity control valve capable of minimizing the influence of a control-chamber pressure on a valve body, capable of performing capacity control more stably, and capable of achieving a reduction in, for example, solenoid size and a reduction in cost while securing a fluid flow obtained when a control chamber and a suction chamber are controlled even if a refrigerant gas having a large pressure area is used.

Means for Solving the Problems

A capacity control valve of the present invention includes a lead-in passage through which a discharge chamber discharging a fluid and a control chamber controlling the amount of a discharged fluid are allowed to communicate with each other and through which the discharged fluid is introduced into the control chamber; a first valve chamber formed midway of the lead-in passage; a lead-out passage through which a suction chamber sucking in a fluid and the control chamber are allowed to communicate with each other and through which a fluid is led out from the control chamber; a second valve chamber formed midway of the lead-out passage; a valve body formed integrally with a first valve part that is disposed in the first valve chamber and opens and closes the lead-in passage and a second valve part that is disposed in the second valve chamber and opens and closes the lead-out passage, the first valve part and the second valve part performing an opening and closing operation in mutually opposite directions by its reciprocation; and a solenoid that exerts an electro-magnetic driving force on the valve body. In the capacity control valve, the valve body has a pressure receiving part that receives a pressure of the control chamber on an opposite side of the first valve part with the second valve part placed there between, and a pressure receiving area of the pressure receiving part is formed to become substantially equal to a difference between a pressure receiving area of the second valve part in the lead-out passage and a pressure receiving area of the first valve part in the lead-in passage.

According to this structure, when the pressure (control-chamber pressure) of the inside of the control chamber is increased, the second valve part closes the lead-out passage, and prevents a fluid from being suctioned from the control chamber to the suction chamber, whereas the first valve part opens the lead-in passage, and leads a discharge fluid (or discharge pressure) from the discharge chamber into the control chamber. On the other side, when the pressure (control-chamber pressure) of the inside of the control chamber is decreased, the first valve part closes the lead-in passage, and prevents a discharge fluid (or discharge pressure) from being introduced from the discharge chamber to the control chamber, whereas the second valve part opens the lead-out passage, and leads out a fluid from the control chamber toward the suction chamber.

In this capacity control, in the valve body, a differential pressure between the discharge pressure and the control-chamber pressure acts on the first valve part, a differential pressure between the control-chamber pressure and the suction pressure acts on the second valve part, and a differential pressure between the suction pressure and the control-chamber pressure acts on the pressure receiving part. Herein, since the pressure receiving area of the pressure receiving part is formed to become substantially equal to a difference between the pressure receiving area of the second valve part and the pressure receiving area of the first valve part, the influence of the control-chamber pressure on the valve body can be minimized, and the optimum capacity control can be performed by applying a control signal corresponding to a pressure load onto the solenoid. Additionally, even if the passage area between the control chamber and the suction chamber is increased when a refrigerant gas (e.g., carbon dioxide) having a large pressure area is used, the solenoid can be reduced in size, and capacity control can be performed in a stabler manner, because the influence of the control-chamber pressure in the pressure load is minimized.

In the above-mentioned structure, the first valve chamber and the second valve chamber may be formed to communicate with each other, and the lead-in passage through which the first valve chamber and the control chamber are allowed to communicate with each other and the lead-out passage through which the second valve chamber and the control chamber are allowed to communicate with each other may be formed as a shared passage.

According to this structure, one valve chamber in which the first valve chamber and the second valve chamber communicate with each other is formed, and the lead-in passage on a downstream side of the first valve chamber and the lead-out passage on an upstream side of the second valve chamber are used as a shared passage. Therefore, the structure can be simplified, and a reduction in size can be achieved.

In the above-mentioned structure, the capacity control valve may further include a third valve chamber to which the pressure receiving part is exposed and which communicates with the control chamber, and the valve body may have the pressure receiving part at an end thereof on an opposite side of the first valve part, and a driving rod that is included in the solenoid and that comes into contact with the pressure receiving part so as to exert an electro-magnetic driving force thereon may be reciprocatably disposed in the third valve chamber.

According to this structure, the first valve chamber in which the first valve part is disposed, the second valve chamber in which the second valve part is disposed (or one valve chamber used both as the first valve chamber and as the second valve chamber), and the third valve chamber to which the pressure receiving part is exposed can be easily arranged in the longitudinal direction (reciprocating direction) of the valve body including the first valve part, the second valve part, and the pressure receiving part, and, accordingly, the solenoid (or the driving rod of the solenoid) can be easily arranged. Therefore, compaction as a whole and structural simplification can be achieved.

In the above-mentioned structure, the capacity control valve may further include a pressure-sensitive body that exerts an urging force on the valve body according to an increase and a decrease in pressure.

According to this structure, since the pressure-sensitive body exerts an urging force on the valve body according to an increase and a decrease in pressure (for example, discharge pressure or suction pressure), smoother capacity control complying with a change in pressure load can be performed.

In the above-mentioned structure, the lead-in passage may be provided with a housing chamber in which the pressure-sensitive body is housed at an upstream side of the first valve chamber; the valve body may have an extension part passing through the lead-in passage and extending from the first valve part to the housing chamber; and the pressure-sensitive body may come into contact with a tip of the extension part in a reciprocating direction of the valve body so as to open the first valve part and so as to close the second valve part according to an increase in discharge pressure.

According to this structure, the first valve chamber in which the first valve part is disposed, the second valve chamber in which the second valve part is disposed (or one valve chamber used both as the first valve chamber and as the second valve chamber), and the housing chamber can be easily arranged in the longitudinal direction (reciprocating direction) of the valve body including the extension part, the first valve part, the second valve part, and the pressure receiving part. Therefore, a smooth operation complying with a change in discharge pressure can be performed, and compaction as a whole and structural simplification can be achieved.

ADVANTAGEOUS EFFECTS OF THE INVENTION

The above-mentioned capacity control valve is capable of minimizing the influence of a control-chamber pressure on the valve body, is capable of performing capacity control more stably, and is capable of achieving a reduction in, for example, solenoid size and a reduction in cost while securing a fluid flow obtained when the control chamber and the suction chamber are controlled even if a refrigerant gas (e.g., carbon dioxide) having a large pressure area is used.

DESCRIPTION OF SIGNS

Figure 1:
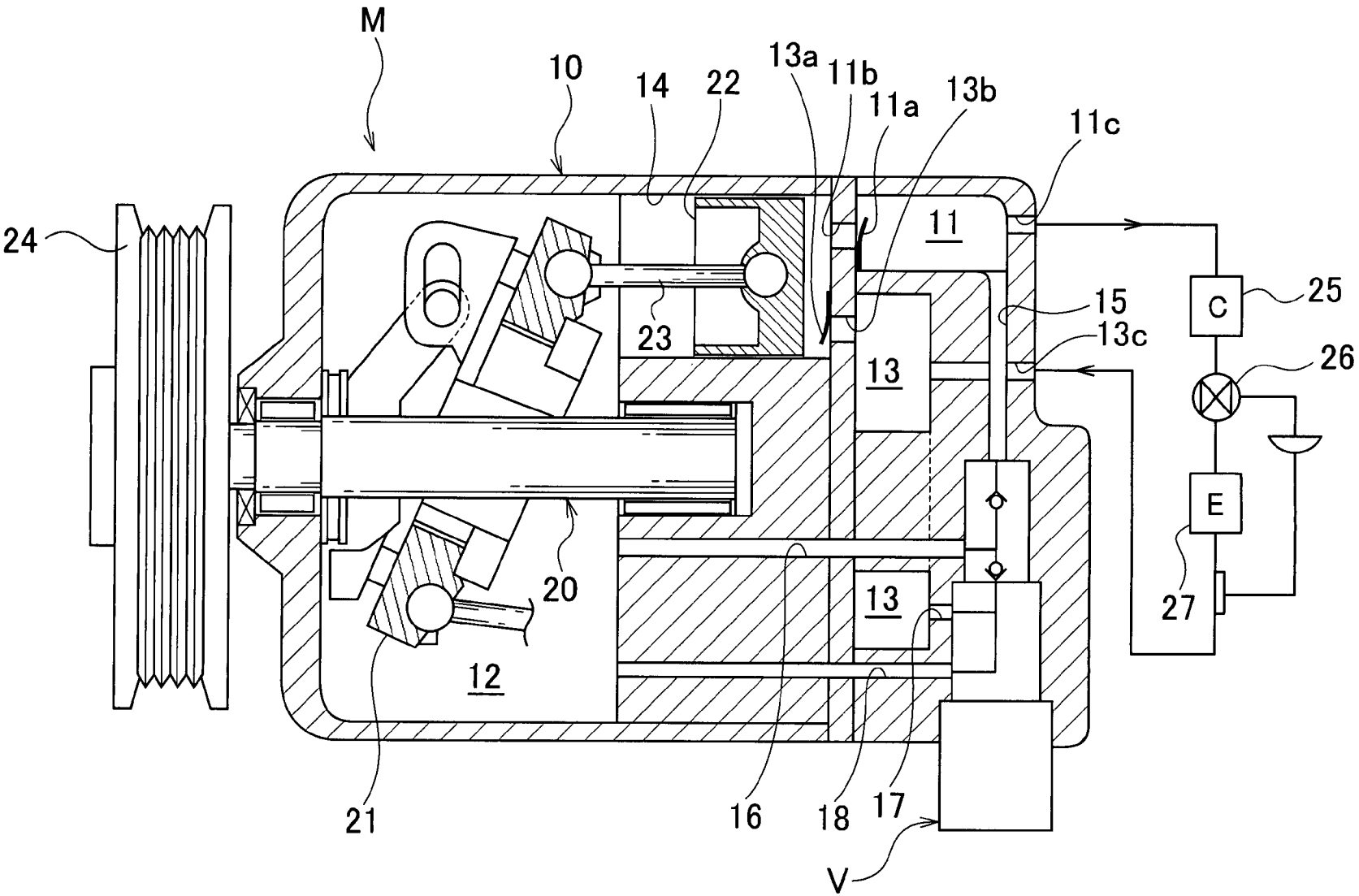
FIG. 1 is a schematic view showing a swash plate type capacity-variable compressor that includes a capacity control valve according to the present invention.

M Swash plate type capacity-variable compressor
V Capacity control valve
10 Casing
11 Discharge chamber
12 Control chamber
13 Suction chamber
14 Cylinder
15 Communication path (lead-in passage)
16 Communication path (lead-in passage, lead-out passage)
17 Communication path (lead-out passage)
18 Communication path
20 Rotary shaft
21 Swash plate
22 Piston
23 Connection rod
24 Driven pulley
25 Condenser
26 Expansion valve
27 Evaporator
30 Body
B1 Partition member
31 (31*a*)Communication path (lead-in passage)
31*a*' First valve seat
31*b* Communication path (lead-in passage, lead-out passage)
(32*a*, 32*b*) Communication path (lead-out passage)
33 Guide path
34 Communication path
35 Enlarged chamber (housing chamber)
36 Valve chamber (first valve chamber, second valve chamber)
37 Valve chamber (third valve chamber)
38 Regulation plate
40,40' Valve body
41 First valve part
42 Second valve part
43 Diameter-reduced part
44 Pressure receiving part
45 Extension part
50 Coil spring
60 Solenoid
61 Solenoid body
62 Casing
63 Sleeve
64 Fixed iron core
65 Driving rod
66 Movable iron core
67 Coil spring
68 Coil
70 Pressure-sensitive body

BEST MODE FOR CARRYING OUT THE INVENTION

The best mode for carrying out the present invention will be herein after described with reference to the accompanying drawings.

First, a description will be given of an embodiment in which a capacity control valve according to the present invention is applied to a swash plate type capacity-variable compressor M with reference to FIG. 1 to FIG. 4.

As shown in FIG. 1, the swash plate type capacity-variable compressor M includes a discharge chamber 11, a control chamber (also called a "crank chamber") 12, a suction chamber 13, a plurality of cylinders 14, a port 11*b* through which the cylinders 14 and the discharge chamber 11 are allowed to communicate with each other and which is opened and closed by a discharge valve 11*a*, a port 13*b* through which the cylinders 14 and the suction chamber 13 are allowed to communicate with each other and which is opened and closed by a suction valve 13*a*, a discharge port 11*c* and a suction port 13*c* connected to an external cooling circuit, a communication path 15 serving as a lead-in passage through which a discharge fluid is introduced into the control chamber 12 from the discharge chamber 11, a communication path 16 serving as the above-mentioned lead-in passage and a lead-out passage through which a fluid is led out from the control chamber 12 toward the suction chamber 13, a communication path 17 serving as a lead-out passage, a casing 10 that defines, for example, a communication path 18 through which the pressure (control-chamber pressure) of the inside of the control chamber 12 is led, a rotary shaft 20 that is rotatably provided and is extended from the inside of the crank chamber 12 outwardly, a swash plate 21 that is rotated together with the rotary shaft 20 and is connected to the rotary shaft 20 such that the inclination angle of the swash plate 21 can be varied with respect to the rotary shaft 20, a plurality of pistons 22 reciprocatably fitted into the cylinders 14 respectively, a plurality of connection rods 23 by each of which the swash plate 21 and each piston 22 are connected to each other, a driven pulley 24 attached to the rotary shaft 20, and a capacity control valve V incorporated into the casing 10.

A cooling circuit is connected to the swash plate type capacity-variable compressor M through the discharge port 11*c* and the suction port 13*c*. The cooling circuit includes a condenser 25, an expansion valve 26, and an evaporator 27, which are arranged in this order.

Figure 2:
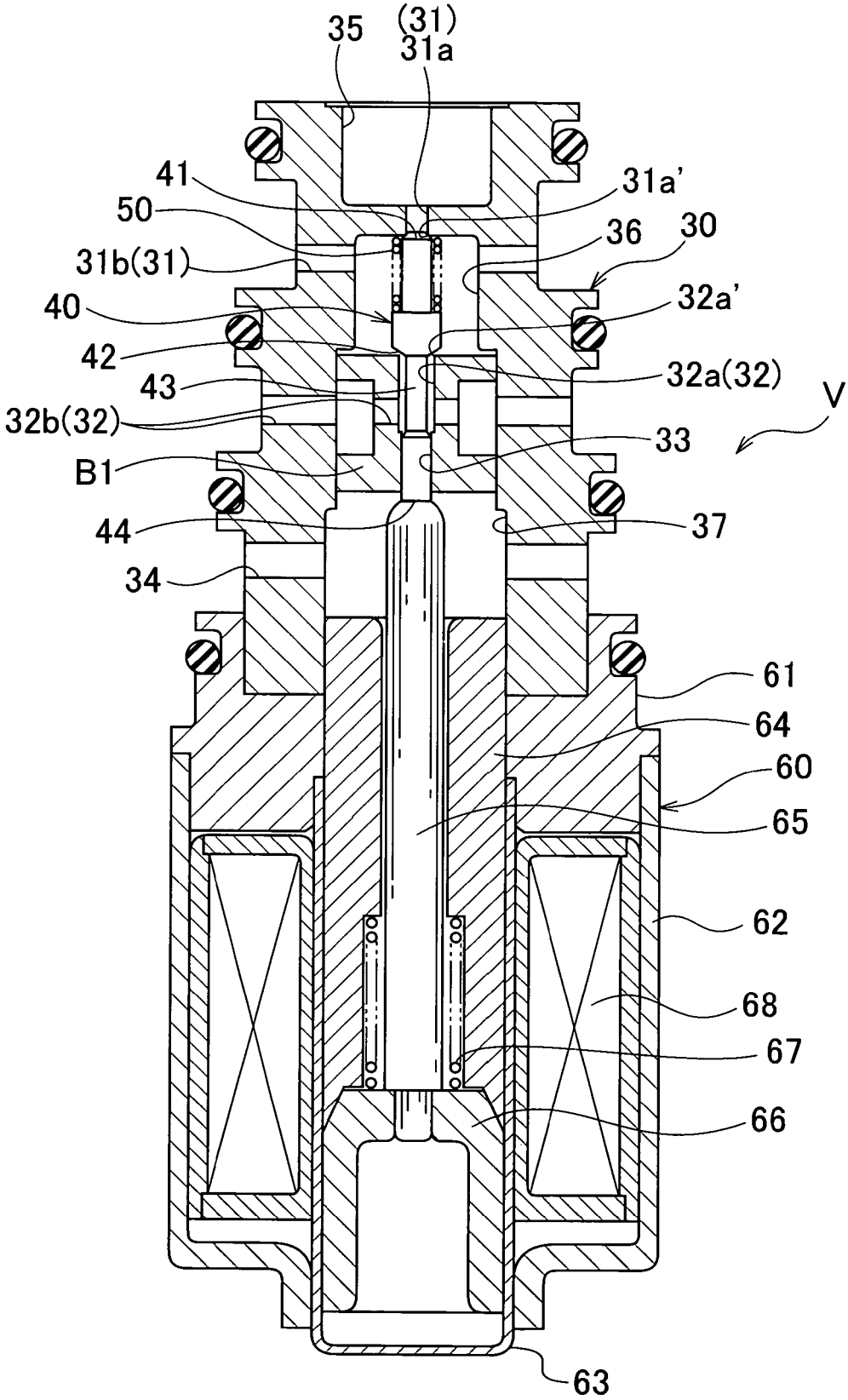
FIG. 2 is a sectional view showing one embodiment of the capacity control valve according to the present invention.

As shown in FIG. 2, the capacity control valve V includes a body 30 made of a metallic or resinous material, a valve body 40 reciprocatably disposed in the body 30, a coil spring 50 by which the valve body 40 is urged in one direction, and a solenoid 60 connected to the body 30 and the like.

As shown in FIG. 2, the body 30 is provided with a communication path 31 (31*a*, 32*b*), a communication path 32 (32*a*, 32*b*), a guide path 33, a communication path 34, an enlarged chamber 35 that is formed on the upstream side of the communication path 32*a* and communicates with the communication path 15 of the casing 10, a valve chamber 36 that is formed in the middle of the communication path 31 and serves as first and second valve chambers communicating with each other, and a valve chamber 37 that is formed between the guide path 33 and the communication path 34 and serves as a third valve chamber.

A first valve seat 31*a*' on which a first valve part 41 of the valve body 40 described later is seated is formed at an end of the communication path 31*a*, and a second valve seat 32*a*' on which a second valve part 42 of the valve body 40 described later is seated is formed at an end of the communication path 32*a*.

The communication path 32*a* and the guide path 33 are defined by a partition member B1 fitted into the body 30. Since the partition member B1 is formed independently of the body 30, the valve body 40 can be reduced in length in its axial direction and can be easily attached, thus making it possible to lower the assembly cost. If a wear-resistance metallic material that differs from that of the body 30 is used as a material for making the partition member B1, the guide path 33 can be prevented from being worn out as much as possible, and the valve body 30 can be stably guided.

As shown in FIG. 2, the valve body 40 is provided integrally with the first valve part 41 whose end has a tapered surface, a second valve part 42 that is greater in diameter than the first valve part 41 and whose end has a tapered surface so as to perform an open-close operation in a direction opposite to the direction of the first valve part 41, a diameter-reduced part 43 reciprocatably inserted in the communication path 32*a*, and a pressure receiving part 44 that is greater in diameter than the diameter-reduced part 43, that is slidably fitted into the guide path 33, and that is exposed to the valve chamber 37.

That is, the pressure receiving part 44 is formed at an end on the opposite side of the first valve part 41 with the second valve part 42 placed between the pressure receiving part 44 and the first valve part 41. Thus, a control-chamber pressure led through the communication path 34 can effectively act by providing the pressure receiving part 44 at the end.

Figure 3:
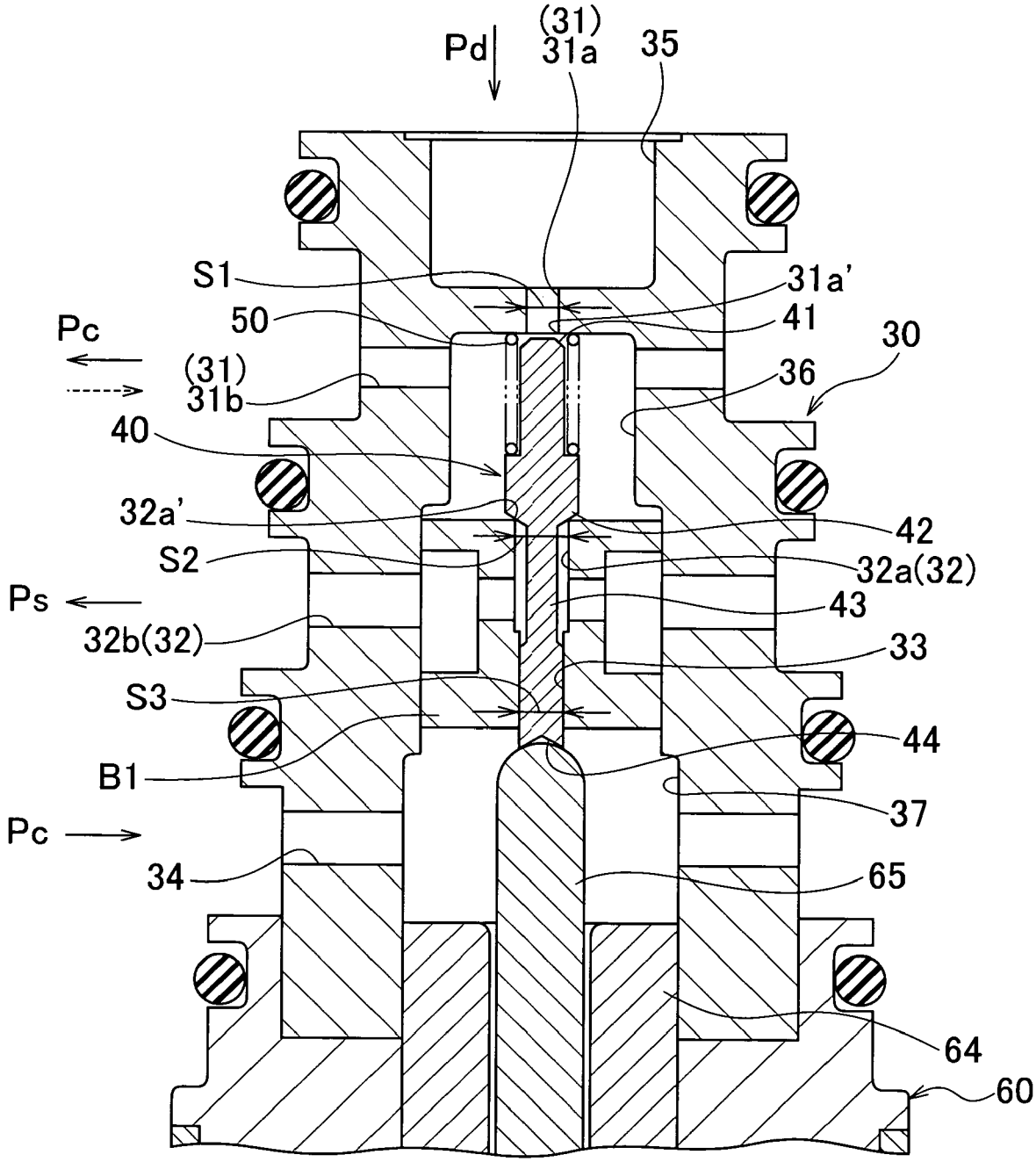
FIG. 3 is a partially enlarged sectional view of the capacity control valve of FIG. 2 whose part is enlarged.
Figure 4:
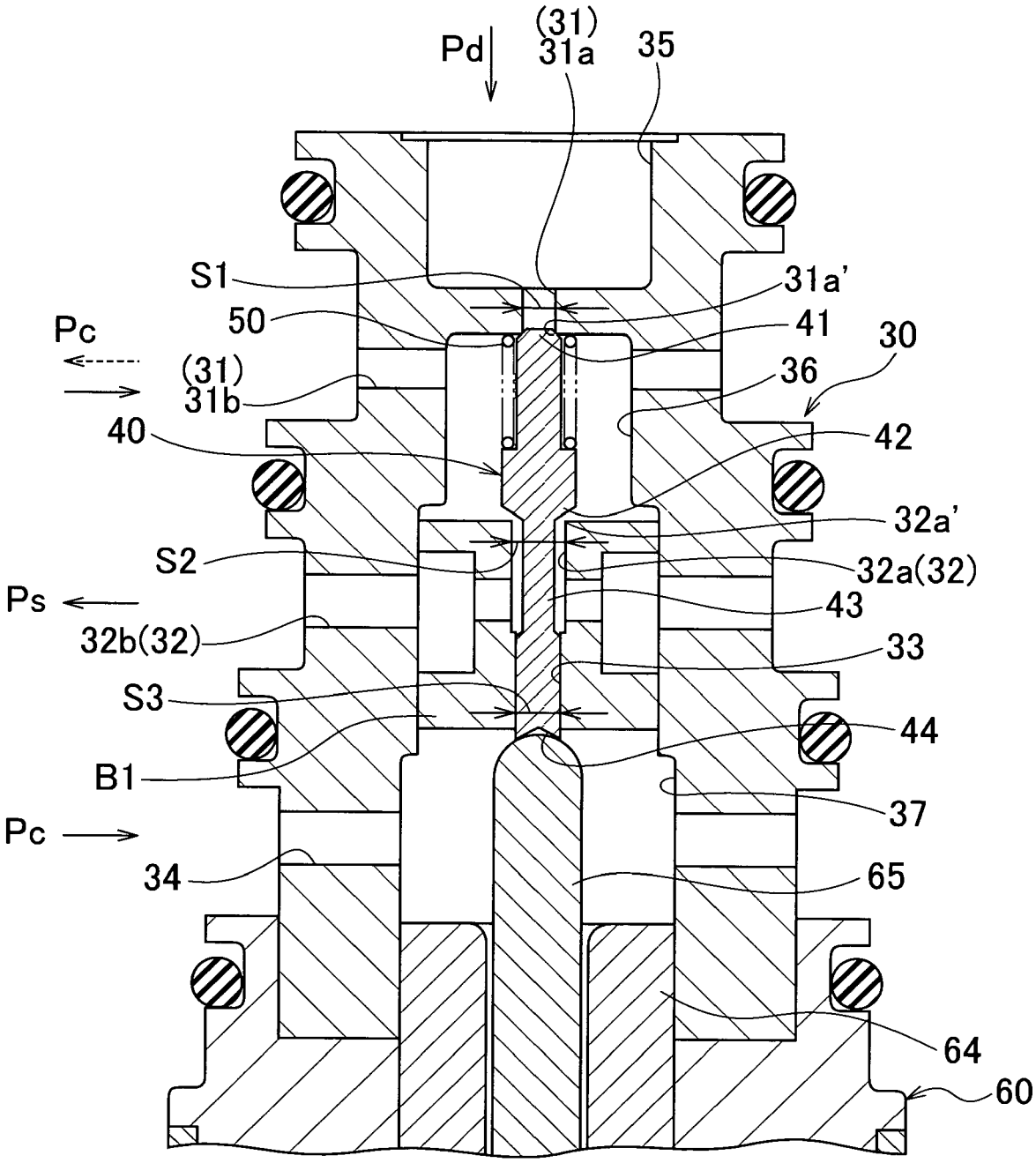
FIG. 4 is a partially enlarged sectional view of the capacity control valve of FIG. 2 whose part is enlarged.

When the valve body 40 is moved downwardly in FIG. 2, the first valve part 41 is separated from the first valve seat 31*a*' so as to open the communication path (lead-in passage) 31*a*, and, at the same time, the second valve part 42 is seated on the second valve seat 32*a*' so as to close the communication path (lead-out passage) 32*a* as shown in FIG. 3. On the other hand, when the valve body 40 is moved upwardly in FIG. 2, the first valve part 41 is seated on the first valve seat 31*a*' so as to close the communication path (lead-in passage) 31*a*, and, at the same time, the second valve part 42 is separated from the second valve seat 32*a*' so as to open the communication path (lead-out passage) 32*a* as shown in FIG. 4.

The coil spring 50 exerts a downward urging force on the valve body 40 in FIG. 2 so that the first valve part 41 opens the communication path 31*a* and so that the second valve part 42 closes the communication path 32*a*.

As shown in FIG. 2, the solenoid 60 includes a solenoid body 61 connected to the body 30, a casing 62 by which the whole of the device is enclosed, a sleeve 63 one end of which is closed, a cylindrical fixed iron core 64 disposed inside the solenoid body 61 and the sleeve 63, a driving rod 65 reciprocatably disposed inside the fixed iron core 64 so that its tip protrudes into the valve chamber 37 and is brought into contact with the pressure receiving part 44, a movable iron core 66 fixed to an opposite end of the driving rod 65, a coil spring 67 that urges the movable iron core 66 in a direction in which the driving rod 65 is separated from the valve body 40, and an exciting coil 68 wound on the outside of the sleeve 63.

In the above-mentioned capacity control valve V, the communication path 31 allows the discharge chamber 11 and the control chamber 12 to communicate with each other, and leads a discharge fluid (refrigerant gas) into the control chamber 12. In detail, in the communication path 31*a*, a discharge pressure Pd acts on the first valve part 41 from the upstream side, and, at the same time, a control-chamber pressure Pc acts thereon from the downstream side.

The communication path 32 allows the control chamber 12 and the suction chamber 13 to communicate with each other, and leads out a fluid (control-chamber pressure Pc) in the control chamber 13 toward the suction chamber 13. In detail, in the communication path 32*a*, a control-chamber pressure Pc acts on the second valve part 42 through the communication path 31*b* from the upstream side, and, at the same time, a suction pressure Ps acts thereon through the communication path 32*b* from the downstream side.

Herein, the first valve chamber in which the first valve part 41 is disposed and the second valve chamber in which the second valve part 42 is disposed are formed in the shape of one valve chamber 36 in which the first and second valve chambers communicate with each other. In addition to this, the communication path 31*b* located on the downstream side of the communication path 31 serves as a lead-in passage that leads a discharge fluid (or discharge pressure Pd) into the control chamber 12, and serves also as a lead-out passage that is located on the upstream side of the communication path 32 and leads out a fluid (or control-chamber pressure Pc) in the control chamber 12 toward the suction chamber 13.

Therefore, the simplification of the structure can be performed, and the capacity control valve V can be reduced in size, as compared with a device in which a first valve chamber and a second valve chamber are formed independently of each other and in which a lead-in passage located on the downstream side of the first valve chamber and a lead-out passage located on the upstream side of the second valve chamber are formed independently of each other.

In the above-mentioned structure, the guide path 33 is formed so as to have an axis line exactly aligned with the communication path 31*a* and the communication path 32*a*, and serves to reciprocatably guide the pressure receiving part 43 of the valve body 40. The communication path 34 leads the control-chamber pressure Pc of the inside of the control chamber 12 toward the third valve chamber 37, and allows this pressure to act on the pressure receiving part 43.

Additionally, in the above-mentioned structure, as shown in FIG. 3, a relationship among a pressure receiving area S1 in which the first valve part 41 is defined by the sectional area of the communication path 31*a*, a pressure receiving area S2 in which the second valve part 42 is defined by the sectional area of the communication path 32*a*, and a pressure receiving area S3 in which the pressure receiving part 44 is defined by the sectional area of the guide path 33 may be formed so as to satisfy the following equation (1):

$$S3 = S2 - S1, \tag{1}$$

in other words, so that the pressure receiving area S3 becomes equal to a difference between the pressure receiving area S2 and the pressure receiving area S1. Without being limited to the same value as the value of S2−S1, the value of S3 may be nearly equal to the value of S2−S1, including its approximate value.

The operation of this structure will be described. The balance of a force acting on the valve body 40 in a state in which the solenoid 60 is energized is expressed by the following equation (2):

$$F = Pd \cdot S1 + Pc \cdot (S2 - S1) - Ps \cdot (S2 - S3) - Pc \cdot S3 + fk1 + fk2 \tag{2}$$

Herein, F is an urging force applied by the solenoid 60 in a direction in which the first valve part 41 is closed, Pd is a discharge pressure, Pc is a control-chamber pressure, Ps is a suction pressure, S1 is a pressure receiving area of the first valve part 41, S2 is a pressure receiving area of the second valve part 42, S3 is a pressure receiving area of the pressure receiving part 44, fk1 is an urging force of the coil spring 50, and fk2 is an urging force of the coil spring 67.

Equation (2) is transformed, and the following equation (3) is obtained:

$$F = S1 \cdot (Pd - Pc) + S2 \cdot (Pc - Ps) + S3 \cdot (Ps - Pc) + fk1 + fk2 \quad (3)$$

When the condition S3=S2−S1, i.e., S1=S2−S3 of equation (1) is substituted for equation (3), equation (3) is transformed into the following equation (4) since the relation S1·Pc=(S2−S3) Pc is satisfied:

$$\begin{aligned} F &= S1 \cdot Pd - (S2 - S3) \cdot Pc + S2 \cdot (Pc - Ps) + S3 \cdot (Ps - Pc) + fk1 + fk2 \quad (4) \\ &= S1 \cdot Pd - (S2 - S3) \cdot Ps + fk1 + fk2 \\ &= S1 \cdot (Pd - Ps) + fk1 + fk2 \end{aligned}$$

That is, the control-chamber pressure Pc is set so that the influence of the control-chamber pressure Pc does not occur as shown in equation (4) mentioned above or so that the influence of the control-chamber pressure Pc is minimized according to the balance relationship of a force applied onto the valve body 40 during a control operation even if the control-chamber pressure Pc exists in the system. Therefore, the valve body 40 can be driven and controlled more swiftly and more stably by a relatively small electromagnetic driving force (urging force) F generated by the solenoid 60. Therefore, in the swash plate type capacity-variable compressor M provided with the capacity control valve V, a change in angle of the swash plate 21, i.e., a change in discharge pressure Pd can be carried out in an extremely short time.

Next, a description will be given of an operation performed when the swash plate type capacity-variable compressor M provided with the capacity control valve V is applied to an automobile air-conditioning system.

First, the rotary shaft 20 is rotated by the rotational driving force of an engine via a transmission belt (not shown) and the driven pulley 24, and, correspondingly, the swash plate 21 is rotated together with the rotary shaft 20. Correspondingly to the rotation of the swash plate 21, the piston 22 is reciprocated inside the cylinder 14 with a stroke corresponding to the inclination angle of the swash plate 21, and a refrigerant gas sucked from the suction chamber 13 into the cylinder 14 is compressed with the piston 22, and is discharged into the discharge chamber 11. The refrigerant gas discharged into the discharge chamber 11 is supplied to the evaporator 27 from the condenser 25 via the expansion valve 26, and is returned to the suction chamber 13 while performing a refrigerating cycle.

Herein, the amount of refrigerant gas discharged is determined by the stroke of the piston 22. The stroke of the piston 22 is determined by the inclination angle of the swash plate 21 controlled by the pressure (control-chamber pressure Pc) of the inside of the control chamber 12.

First, in an operating state in which the amount of refrigerant gas discharged is lowest, the solenoid 60 (i.e., coil 68) is in a non-energized state, and the movable iron core 66 and the driving rod 65 are allowed to recede by the urging force of the coil spring 67, and are stopped at a position of rest. The valve body 40 is moved by the urging force of the coil spring 50 as shown in FIG. 3. The first valve part 41 is separated from the first valve seat 31*a*' so as to open the communication path (lead-in passage) 31*a*, where as the second valve part 42 is seated on the second valve seat 32*a*' so as to close the communication path (lead-out passage) 32*a*.

As a result, a discharge fluid (discharge pressure Pd) is led into the control chamber 12 through the communication paths (lead-in passages) 32*a* and 32*b*. The swash plate 21 is controlled to have a smallest inclination angle, and the stroke of the piston 22 is minimized. As a result, the amount of refrigerant gas discharged becomes lowest. In this flow control, only the discharge pressure Pd and the suction pressure Ps substantially act on the valve body 40, and the control-chamber pressure Pc exerts no influence on the valve body 40 when the valve body 40 is driven. Therefore, capacity control is performed in swift and stable manners.

On the other hand, in an operating state in which the amount of refrigerant gas discharged is highest, the solenoid 60 (i.e., coil 68) is energized, and the movable iron core 66 and the driving rod 65 move the valve body 40 against the urging force of the coil springs 50 and 67 as shown in FIG. 4. The first valve part 41 is seated on the first valve seat 31*a*' so as to close the communication path (lead-in passage) 31*a*, where as the second valve part 42 is separated from the second valve seat 32*a*' so as to open the communication path (lead-out passage) 32*a*.

As a result, a fluid (refrigerant gas, blow by gas, etc.) flowing in the control chamber 12 is led out toward the suction chamber 13 through the communication paths (lead-out passages) 31*b*, 32*a*, and 32*b*. The swash plate 21 is controlled to have a largest inclination angle, and the stroke of the piston 22 is maximized. As a result, the amount of refrigerant gas discharged becomes highest.

Likewise, in this flow control, only the discharge pressure Pd and the suction pressure Ps substantially act on the valve body 40, and the control-chamber pressure Pc exerts no influence on the valve body 40 when the valve body 40 is driven. Therefore, capacity control is performed in swift and stable manners.

In an operating state in which the amount of refrigerant gas discharged is intermediate between the lowest and the highest, the solenoid 60 (coil 67) is controlled to have a proper amount of energization, and the electro-magnetic driving force (urging force) is varied. In other words, the valve opening amount of the first valve part 41 and the valve opening amount of the second valve part 42 are controlled to have a desired amount of refrigerant gas discharged while properly adjusting the position of the valve body 40 by use of the electromagnetic driving force.

Likewise, in this flow control, only the discharge pressure Pd and the suction pressure Ps substantially act on the valve body 40, and the control-chamber pressure Pc exerts no influence on the valve body 40 when the valve body 40 is driven. Therefore, capacity control is performed in swift and stable manners.

Figure 5:
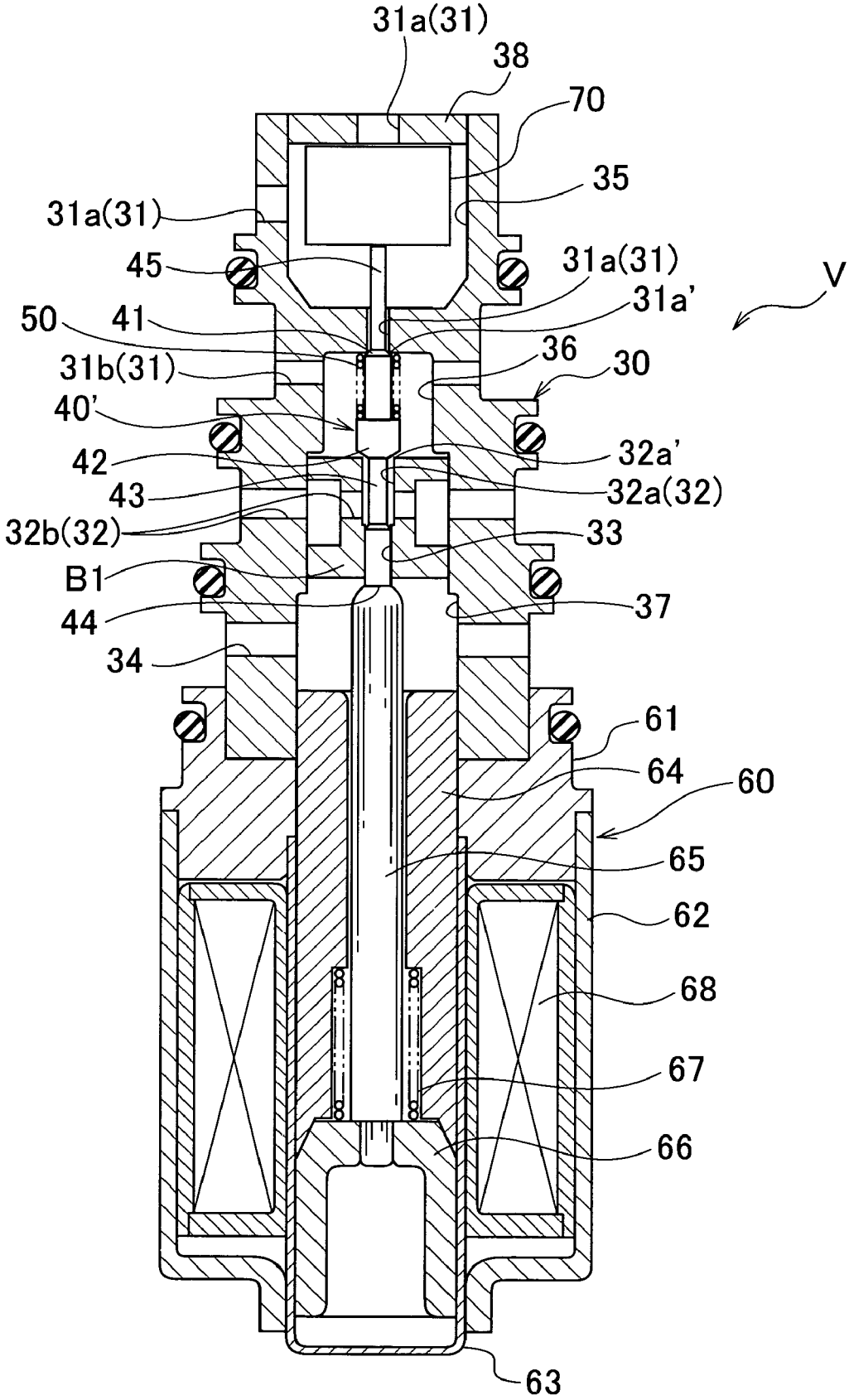
FIG. 5 is a sectional view showing another embodiment of the capacity control valve according to the present invention.
Figure 6:
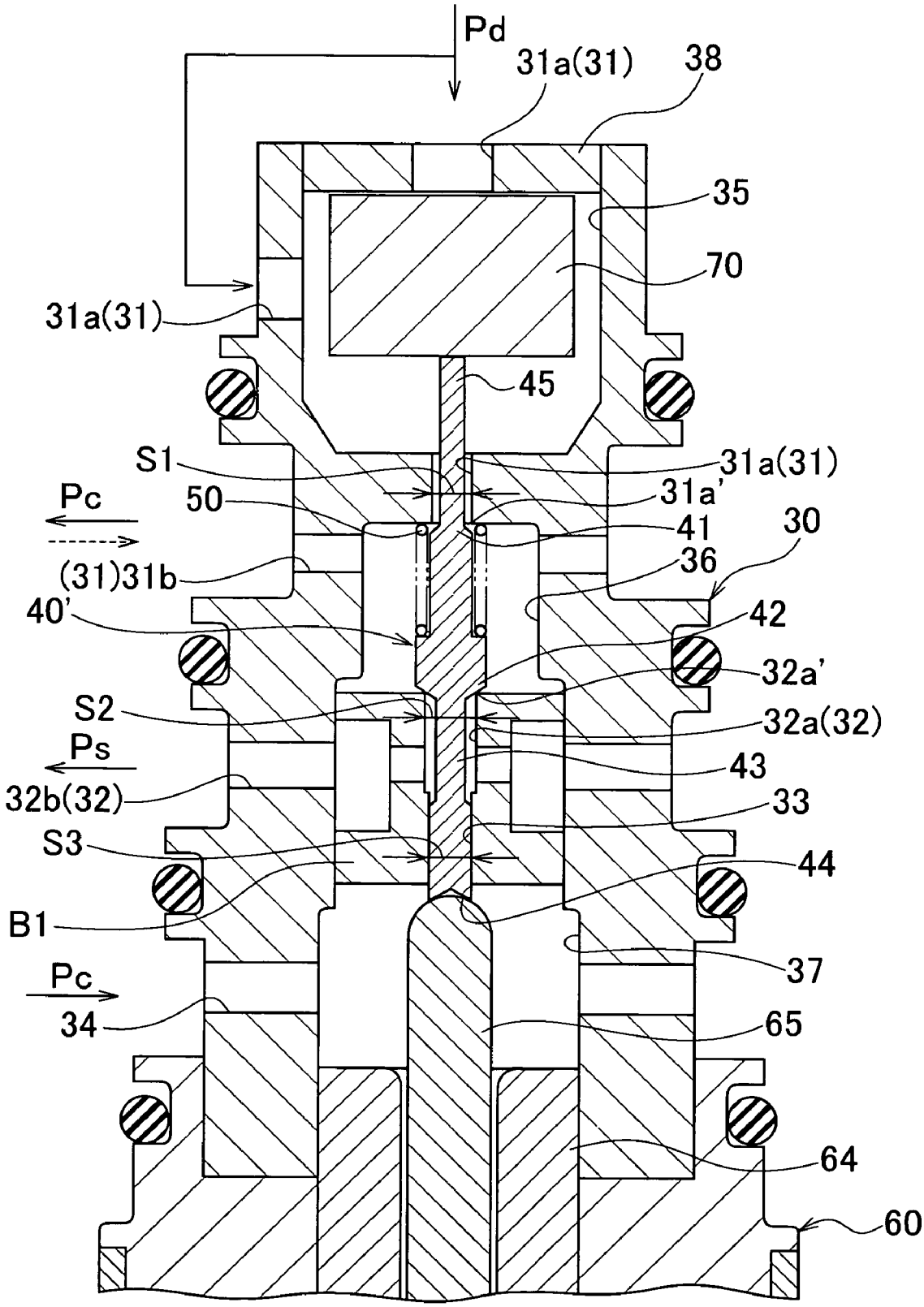
FIG. 6 is a partially enlarged sectional view of the capacity control valve of FIG. 5 whose part is enlarged.
Figure 7:
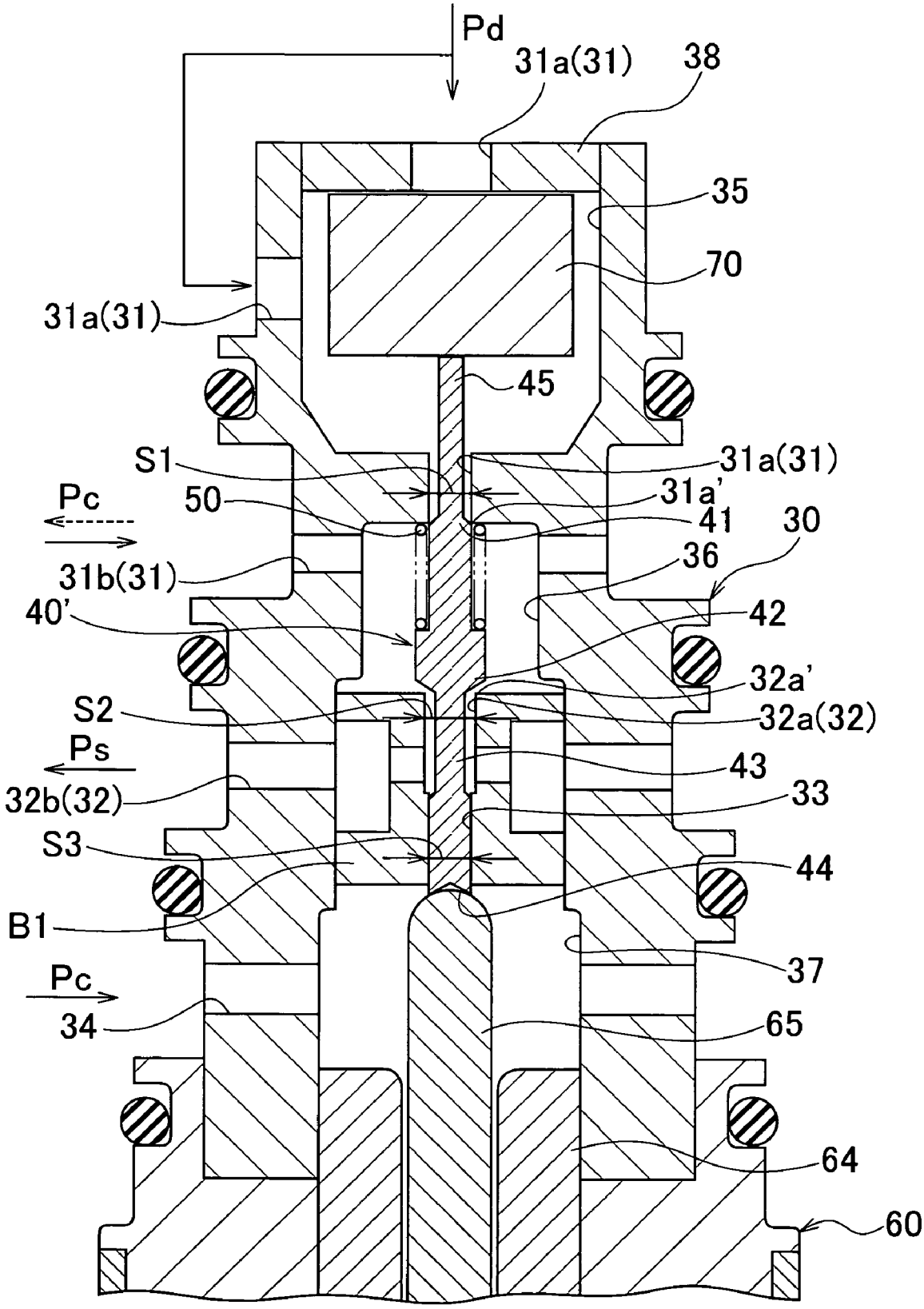
FIG. 7 is a partially enlarged sectional view of the capacity control valve of FIG. 5 whose part is enlarged.

FIG. 5 to FIG. 7 show another embodiment of the capacity control valve according to the present invention. This embodiment is the same as the above-mentioned embodiment except that the valve body is modified and that a pressure-sensitive body is provided. Therefore, in this embodiment, the same reference numeral is given to the same structure as in the above-mentioned embodiment, and a description of the same structure is omitted.

In the capacity control valve V regarding this embodiment, a regulation plate 38 is connected to the enlarged chamber 35 of the body 30, and the enlarged chamber 35 is formed as a housing chamber in which a pressure-sensitive body 70 is housed as shown in FIG. 5. A communication path 31*a* serving as a lead-in passage is formed in the sidewall of the regulation plate 38 and the enlarged chamber 35.

An extension part 45 extending from the first valve part 41 is formed integrally with a valve body 40'. The extension part 45 passes through the communication path 31*a*, and protrudes into the enlarged chamber 35 used as a housing chamber, and has a tip of the extension part 45 comes into contact with the pressure-sensitive body 70.

According to an increase in discharge pressure Pd, the pressure-sensitive body 70 is deformed so as to exert an urging force on the valve body 40', i.e., so as to come into contact with the extension part 45 and to exert an urging force thereon, thereby opening the first valve part 41 and closing the second valve part 42. The pressure-sensitive body 70 can employ a bellows structure, a diaphragm structure, or other structures.

In other words, in the communication path (lead-in passage) 31*a*, the pressure-sensitive body 70 is disposed in the enlarged chamber (housing chamber) 35 located on the upstream side of the valve chamber 36, and is engaged with the tip of the extension part 45 of the valve body 40', passing through the communication path (lead-in passage) 31*a* and extending from the valve chamber 36 to the enlarged chamber 35. As a result, according to an increase in discharge pressure Pd, the first valve part 41 is opened, and the second valve part 42 is closed. Therefore, when the pressure-sensitive body 70 senses an increase in discharge pressure Pd in a state in which an electromagnetic driving force (urging force) is given by the solenoid 60 as shown in FIG. 7, the urging force is exerted on the extension part 45 of the valve body 40' so as to move the valve body 40' quickly in a direction in which the first valve part 41 is opened and the second valve part 42 is closed as shown in FIG. 6.

As a result, for example, when the discharge pressure Pd is increased by a load change, the pressure-sensitive body 70 performs control so as to quickly reach a stable state having a desired amount of refrigerant gas discharged while working in a direction in which the increase of the discharge pressure Pd is decreased.

Additionally, the valve chamber 36 in which the first and second valve parts 41 and 42 are disposed, the enlarged chamber 35 in which the pressure-sensitive body 70 is housed, and the valve chamber 37 to which the pressure receiving part 44 is exposed can be easily arranged in the longitudinal direction (reciprocating direction) of the valve body 40', so that a smooth operation complying with a change in discharge pressure Pd can be obtained, and compaction and structural simplification can be achieved as a whole.

In the above-mentioned embodiment, the valve chamber 36 is formed in the shape of a single valve chamber allowing the first valve chamber in which the first valve part 41 is disposed and the second valve chamber in which the second valve part 42 is disposed to communicate with each other, and the communication path 31*b* is formed in the shape of a shared communication path that serves as the lead-in passage leading from the first valve chamber to the control chamber 12 and serves as the lead-out passage leading from the control chamber 12 to the second valve chamber. However, without being limited to this, the first valve chamber and the second valve chamber may be formed independently of each other, and the lead-in passage and the lead-out passage may be formed independently of each other.

Additionally, in the above-mentioned embodiment, the pressure-sensitive body 70 is formed as a body exerting an urging force on the valve body 40' so as to open the first valve part 41 and so as to close the second valve part 42 according to an increase in discharge pressure Pd. However, without being limited to this, a structure may be employed in which an urging force is exerted on a valve body according to an increase or a decrease in suction pressure Ps.

INDUSTRIAL APPLICABILITY

As described above, the capacity control valve of the present invention is capable of minimizing the influence of a control-chamber pressure on a valve body, is capable of performing capacity control more stably, and is capable of achieving a reduction in, for example, solenoid size and a reduction in cost while securing a fluid flow obtained when a control chamber and a suction chamber are controlled. Therefore, the capacity control valve of the present invention can, of course, be applied to a capacity-variable compressor used in an air-conditioning system of, for example, an automobile, and is useful as a capacity control valve that performs capacity control in a machine for variably controlling the capacity of other fluids.

The invention claimed is:

1. A capacity control valve comprising:

a lead-in passage through which a discharge chamber discharging a fluid and a control chamber controlling an amount of a discharged fluid are allowed to communicate with each other and through which the discharged fluid is introduced into the control chamber;

a first valve chamber formed midway of the lead-in passage;

a lead-out passage through which a suction chamber sucking in a fluid and the control chamber are allowed to communicate with each other and through which a fluid is led out from the control chamber;

a second valve chamber formed midway of the lead-out passage;

a valve body formed integrally with a first valve part that is disposed in the first valve chamber and opens and closes the lead-in passage and a second valve part that is disposed in the second valve chamber and opens and closes the lead-out passage, the first valve part and the second valve part performing an opening and closing operation in mutually opposite directions by reciprocation thereof; and a solenoid that exerts an electro-magnetic driving force on the valve body;

wherein the valve body has a pressure receiving part that receives a pressure of the control chamber on an opposite side of the first valve part with the second valve part placed there between; and wherein a pressure receiving area of the pressure receiving part is formed to become substantially equal to a difference between a pressure receiving area of the second valve part in the lead-out passage and a pressure receiving area of the first valve part in the lead-in passage.

2. The capacity control valve according to claim 1, wherein the first valve chamber and the second valve chamber are formed to communicate with each other, and a lead-in passage through which the first valve chamber and the control chamber are allowed to communicate with each other and a lead-out passage through which the second valve chamber and the control chamber are allowed to communicate with each other are formed as a shared passage.

3. The capacity control valve according to claim 1, further comprising a third valve chamber to which the pressure receiving part is exposed and which communicates with the control chamber, wherein the valve body has the pressure receiving part at an end thereof on an opposite side of the first valve part, and a driving rod that is included in the solenoid and that comes into contact with the pressure receiving part so as to exert an electro-magnetic driving force thereon is reciprocatably disposed in the third valve chamber.

4. The capacity control valve according to claim 1, further comprising a third valve chamber to which the pressure receiving part is exposed and which communicates with the control chamber, wherein the first valve chamber and the second valve chamber are formed to communicate with each other;

a lead-in passage through which the first valve chamber and the control chamber are allowed to communicate with each other and a lead-out passage through which the second valve chamber and the control chamber are allowed to communicate with each other are formed as a shared passage;

the valve body has the pressure receiving part at an end thereof on an opposite side of the first valve part, and a driving rod of the solenoid that comes into contact with the pressure receiving part so as to exert an electromagnetic driving force thereon is reciprocatably disposed in the third valve chamber.

5. The capacity control valve according to claim 1, further comprising a pressure-sensitive body that exerts an urging force on the valve body according to an increase and a decrease in pressure.

6. The capacity control valve according to claim 2, further comprising a pressure-sensitive body that exerts an urging force on the valve body according to an increase and a decrease in pressure.

7. The capacity control valve according to claim 3, further comprising a pressure-sensitive body that exerts an urging force on the valve body according to an increase and a decrease in pressure.

8. The capacity control valve according to claim 4, further comprising a pressure-sensitive body that exerts an urging force on the valve body according to an increase and a decrease in pressure.

9. The capacity control valve according to claim 5, wherein the lead-in passage is provided with a housing chamber in which the pressure-sensitive body is housed at an upstream side of the first valve chamber;

the valve body has an extension part passing through the lead-in passage and extending from the first valve part to the housing chamber; and the pressure-sensitive body comes into contact with a tip of the extension part in a reciprocating direction of the valve body, and opens the first valve part and closes the second valve part according to an increase in discharge pressure.

10. The capacity control valve according to claim 6, wherein the lead-in passage is provided with a housing chamber in which the pressure-sensitive body is housed at an upstream side of the first valve chamber;

the valve body has an extension part passing through the lead-in passage and extending from the first valve part to the housing chamber; and the pressure-sensitive body comes into contact with a tip of the extension part in a reciprocating direction of the valve body, and opens the first valve part and closes the second valve part according to an increase in discharge pressure.

11. The capacity control valve according to claim 7, wherein the lead-in passage is provided with a housing chamber in which the pressure-sensitive body is housed at an upstream side of the first valve chamber;

the valve body has an extension part passing through the lead-in passage and extending from the first valve part to the housing chamber; and the pressure-sensitive body comes into contact with a tip of the extension part in a reciprocating direction of the valve body, and opens the first valve part and closes the second valve part according to an increase in discharge pressure.

12. The capacity control valve according to claim 8, wherein the lead-in passage is provided with a housing chamber in which the pressure-sensitive body is housed at an upstream side of the first valve chamber;

the valve body has an extension part passing through the lead-in passage and extending from the first valve part to the housing chamber; and the pressure-sensitive body comes into contact with a tip of the extension part in a reciprocating direction of the valve body, and opens the first valve part and closes the second valve part according to an increase in discharge pressure.

* * * * *